US007641084B1

(12) United States Patent
Alcaraz

(10) Patent No.: US 7,641,084 B1
(45) Date of Patent: Jan. 5, 2010

(54) ADJUSTABLE CLOTHES HANGER AND ASSOCIATED METHOD

(76) Inventor: Claudia Alcaraz, 3835 Maxon La., Chino, CA (US) 91710

( * ) Notice: Subject to any disclaimer, the term of this patent is extended or adjusted under 35 U.S.C. 154(b) by 0 days.

(21) Appl. No.: 12/001,116

(22) Filed: Dec. 10, 2007

Related U.S. Application Data

(60) Provisional application No. 60/757,520, filed on Dec. 11, 2006.

(51) Int. Cl.
*A41D 27/22* (2006.01)

(52) U.S. Cl. ..... 223/94; 223/89; 223/92

(58) Field of Classification Search ..... 223/85, 223/88, 89, 94, 98, 92
See application file for complete search history.

(56) References Cited

U.S. PATENT DOCUMENTS

| | | | | | |
|---|---|---|---|---|---|
| 1,546,609 | A * | 7/1925 | Scheinman | ..... | 223/92 |
| 1,766,275 | A * | 6/1930 | Allen | ..... | 223/88 |
| 1,842,886 | A * | 1/1932 | Trowbridge | ..... | 223/92 |
| 2,096,303 | A * | 10/1937 | Kroll | ..... | 223/92 |
| 2,132,895 | A * | 10/1938 | Fewster | ..... | 223/92 |
| 2,477,873 | A * | 8/1949 | Hopkins et. al. | ..... | 223/89 |
| 2,516,297 | A * | 7/1950 | Burpee | ..... | 223/92 |
| 3,024,954 | A * | 3/1962 | Michlin | ..... | 223/95 |
| 5,044,535 | A * | 9/1991 | Hunt | ..... | 223/85 |
| 5,397,038 | A * | 3/1995 | Hunt | ..... | 223/89 |
| 5,456,391 | A * | 10/1995 | Chang | ..... | 223/94 |
| 5,511,701 | A * | 4/1996 | Lam | ..... | 223/85 |
| 5,664,710 | A * | 9/1997 | Lam | ..... | 223/94 |
| 6,065,652 | A * | 5/2000 | Dooling-Sherman | ..... | 223/93 |
| 6,409,058 | B1 * | 6/2002 | Lam et al. | ..... | 223/94 |
| 6,644,520 | B2 * | 11/2003 | Lam | ..... | 223/94 |
| 2002/0056735 | A1 * | 5/2002 | Lam | ..... | 223/94 |
| 2005/0035159 | A1 * | 2/2005 | Hunt et al. | ..... | 223/94 |
| 2007/0075103 | A1 * | 4/2007 | Stubbers | ..... | 223/85 |

* cited by examiner

*Primary Examiner*—Gary L Welch
*Assistant Examiner*—Nathan E Durham

(57) ABSTRACT

An adjustable clothes hanger includes a hollow body provided with a chamber formed therein, first and second arms conjoined to the body and disposed exterior of the chamber, and a mechanism for slidably and linearly displacing the first and second arms along respective linear paths in such a manner that the first and second arms simultaneously extend and retract along opposed flanges of the body. The device further includes first and second hooks partially seated within the chamber and disposed along the flanges. Each of such first and second hooks has top ends terminating outwardly from the chamber and traversing respective travel paths of the first and second arms when the primary and secondary dials are rotated in corresponding directions such that the first and second arms are engaged and stopped from traveling therebeyond.

9 Claims, 5 Drawing Sheets

ADJUSTABLE CLOTHES HANGER AND ASSOCIATED METHOD

CROSS REFERENCE TO RELATED APPLICATIONS

This application claims the benefit of U.S. Provisional Application No. 60/757,520, filed Dec. 11, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to clothes hangers and, more particularly, to an adjustable clothes hanger for accommodating alternate sized garments.

2. Prior Art

For most people, household chores are a fact of life. Vacuuming debris from carpeting, polishing furniture, waxing floors and cleaning windows are necessary tasks which must be done regularly to ensure a healthy and clean household. In particular, most consumers wash laundry on a regular basis. Whether tossing a child's dirty baseball uniform into the wash before a big game, laundering bed linens for unexpected company, or simply washing soiled bath towels and washcloths for the next day's use, most people utilize a washing machine at least once a week. For those consumers with large families and children, laundry must be washed on a daily basis, simply in order to keep all household members in clean clothing. Once clothes have been cleaned in a washing machine, the next step typically involves hanging the laundered clothing on a wire or plastic hanger. Hangers are extremely useful devices which enable consumers to keep clean or freshly pressed clothing neat and wrinkle-free between wear.

While hangers are practical household tools, use of these devices is not without drawbacks. Specifically, certain clothing items such as oversized sweaters, jackets and similar goods, are simply too large and heavy to be fully supported by an average hanger. Further, delicate fabric material such as wool, angora, silk, rayon and other fine linen, can become easily misshapen when hung on standard wire or plastic hangers. As many consumers would attest, donning an expensive cashmere sweater, only to find that unsightly conical "bumps" have formed on the sweater's neckline as a result of hanging heavily off the ends of the hanger, can be an extremely frustrating experience.

U.S. Pat. No. 7,287,674 to Sutton discloses a garment hanger system including a hook member, a hanger body and an information indicator mounted on the hanger body. The hanger body includes a reinforcing rib section disposed adjacent a mounting structure that receives the hook member. The information indicator is adapted to mount around the hook member and detachably interlock with the reinforcing rib section. The information indicator includes one or more walls defining a top opening and a hollow cavity. Preferably, the end of the hook member passes through the top opening such that the indictor can slide down the hook member. The sidewalls of the indicator are preferably adapted, for example, with locking nibs, to detachably interlock to the reinforcing rib section of the hanger body. Unfortunately, this prior art example does not include adjustable hooks for hanging tank tops or the like.

U.S. Pat. No. 7,234,671 to Avinger discloses an adjustable wreath hanger, preferably made of molded plastic, that preferably comprises a hanger strip attachable to the top of a door or other object and a hook strip that slidably engages the hanger strip to permit selective variation of the distance between a rearwardly facing door hook and a forwardly facing wreath hook. The hanger strip preferably comprises a plurality of forwardly facing detent members into which a tooth projecting rearwardly from an engagement tab on the hook strip can be selectively engaged or disengaged to vary the relative positions of the two strips, thereby effectively elongating the length of the wreath hanger. Unfortunately, this prior art example does not include adjustable hooks for hanging tank tops or the like.

U.S. Pat. No. 7,243,823 to Cresap discloses an apparel apparatus that is especially useful for hanging narrow or small necked shirts and sweaters. It is a collapsible garment hanger, or clothing hanger, that has moving parts. There are two hanger arms that rotate about pins on a hanger body, and there is a fulcrum about which a quick-release lever and release tabs pivot so that a locking mechanism can be manipulated. All of the parts used with the apparatus are inexpensive plastic parts that can be injection molded, and the apparatus can be quickly assembled by snapping parts together. Unfortunately, this prior art example does not include adjustable hooks for hanging tank tops or the like.

Accordingly, the present invention is disclosed in order to overcome the above noted shortcomings. The present invention is convenient and easy to use, lightweight yet durable in design, and designed for accommodating alternate sized garments. The present invention is simple to use, inexpensive, and designed for many years of repeated use.

BRIEF SUMMARY OF THE INVENTION

In view of the foregoing background, it is therefore an object of the present invention to provide a device for accommodating alternate sized garments. These and other objects, features, and advantages of the invention are provided by an adjustable clothes hanger.

An adjustable clothes hanger includes a hollow body effectively provided with a chamber formed therein, and first and second arms conjoined to the body and disposed exterior of the chamber.

The device further includes a mechanism for slidably and linearly displacing the first and second arms along respective linear paths in such a manner that the first and second arms simultaneously extend and retract along opposed flanges of the body. Such a slidably and linearly displacing mechanism includes first and second rectilinear rods with respective distal ends directly anchored to the distal ends of the first and second arms in such a manner that the distal ends are conveniently disposed externally of the chamber when the first and second arms are adapted to laterally extend positions respectively.

The mechanism further includes a primary dial seated within the chamber that rotates in clockwise and counter clockwise directions, and a secondary dial seated within the chamber and directly engaged with the primary dial. Such a secondary dial is advantageously rotated along counter clockwise and clockwise directions when the primary dial is rotated in clockwise and counter clockwise directions respectively. The slidably and linearly displacing mechanism further includes a mechanism for providing a resilient force that resists undesirable rotation of the primary dial when the garments are supported and removed by the first and second arms. Each of the primary and secondary dials is provided with a plurality of teeth juxtaposed along respective outer perimeters thereof.

The resilient force providing mechanism includes a deformably resilient spring member oriented along a sloping angle offset from a horizontal plane such that a bottom end of the spring members is effectively seated adjacent to the primary dial while a top end of the spring member is anchored to an inner surface of the body. A finger is monolithically formed with the body and nested within the chamber, and such a finger is juxtaposed adjacent to the primary dial and adjoined to the outer perimeter thereof. The mechanism further includes a bracket pivotally coupled directly to the finger. Such a bracket is coupled directly to the spring member and rotated along an arcuate path defined along the outer perimeter of the primary dial such that the bracket selectively engages the teeth of the primary dial as the spring member is adapted between compressed and equilibrium positions respectively. The spring member is compressed when the bracket engages the outer perimeter of the primary dial, and the first and second rectilinear rods are coupled directly to the primary and secondary dials respectively.

The device further includes first and second hooks partially seated within the chamber and disposed along the flanges. Each of such first and second hooks conveniently has top ends terminating outwardly from the chamber and traversing respective travel paths of the first and second arms when the primary and secondary dials are rotated in corresponding directions such that the first and second arms are engaged and stopped from traveling therebeyond. The first and second arms are prohibited from medially traveling beyond corresponding limits defined towards a center of the body, and a primary hook is rotatably connected to a top edge of the body and disposed exterior of the chamber.

A method for adjusting a size of a clothes hanger in order to accommodate alternate sized garments includes the steps of: providing a hollow body with a chamber formed therein; conjoining first and second arms to the body by disposing the first and second arms exterior of the chamber; providing first and second hooks partially seated within the chamber and disposed along flanges of the body; slidably and linearly displacing the first and second arms along respective linear paths in such a manner that the first and second arms simultaneously extend and retract along opposed flanges of the body; and traversing top ends of the hooks along travel paths of the first and second arms by rotating the primary and secondary dials in corresponding directions such that the first and second arms are engaged and stopped from traveling therebeyond.

The method further includes the steps of: providing first and second rectilinear rods with respective distal ends directly anchored to the distal ends of the first and second arms; externally disposing the distal ends from the chamber by adapting the first and second arms to laterally extended positions respectively; providing a primary dial seated within the chamber; rotating the primary dial in clockwise and counter clockwise directions; providing a secondary dial seated within the chamber by directly engaging the secondary dial with the primary dial; rotating the secondary dial along counter clockwise and clockwise directions by rotating the primary dial in clockwise and counter clockwise directions respectively; and providing a resilient force that resists undesirable rotation of the primary dial when the garments are supported and removed by the first and second arms.

The method further includes the steps of: orienting a deformably resilient spring member along a sloping angle offset from a horizontal plane such that a bottom end of the spring members is seated adjacent to the primary dial; anchoring a top end of the spring member to an inner surface of the body; providing a finger monolithically formed with the body and nested within the chamber; providing a bracket pivotally coupled directly to the finger; and rotating the bracket along an arcuate path defined along the outer perimeter of the primary dial such that the bracket selectively engages the teeth of the primary dial as the spring member is adapted between compressed and equilibrium positions respectively.

The method further includes the steps of: compressing the spring member by engaging the bracket with the outer perimeter of the primary dial; and rotatably connecting a primary hook to a top edge of the body and disposed exterior of the chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
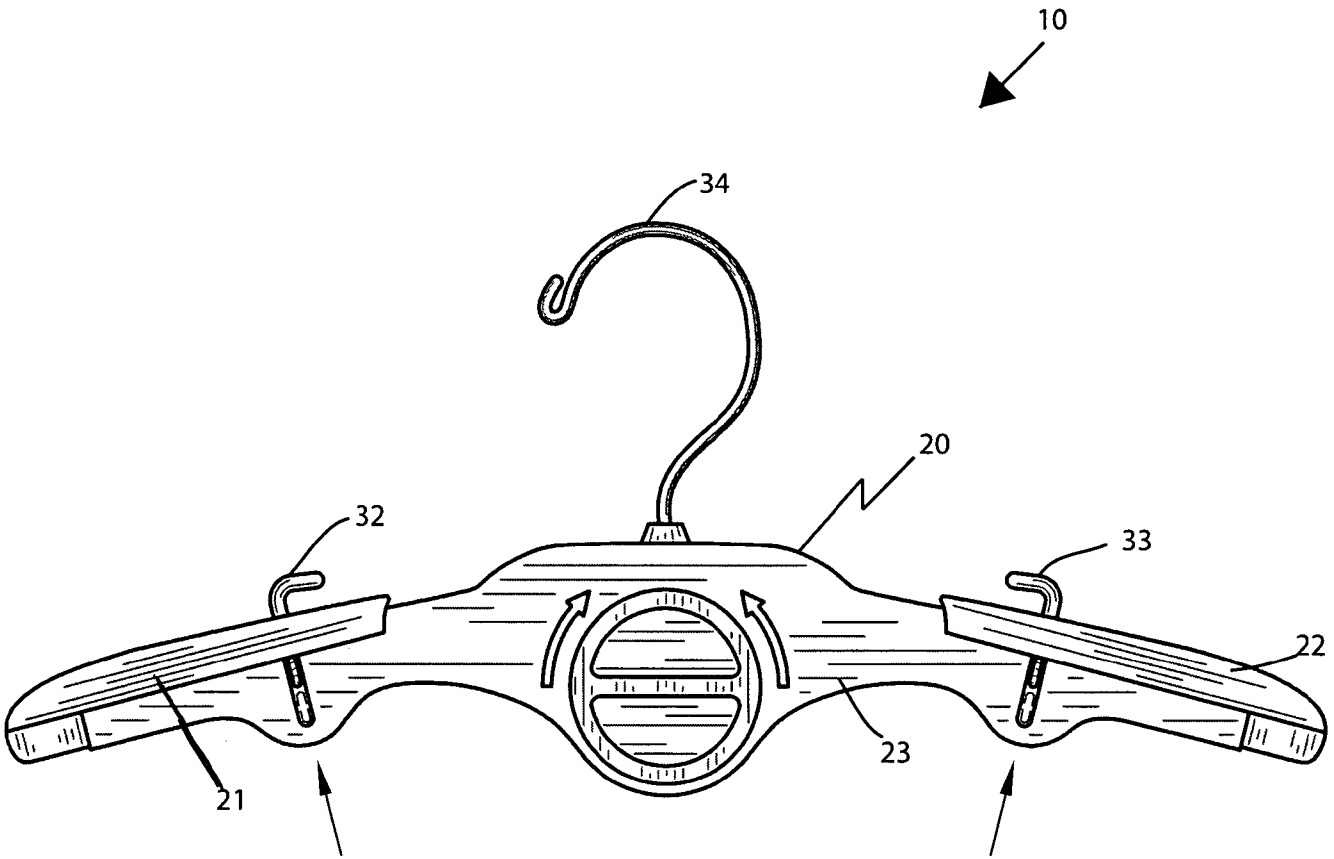
FIG. 1 is a front elevational view of an adjustable clothes hanger, in accordance with the present invention.
Figure 2:
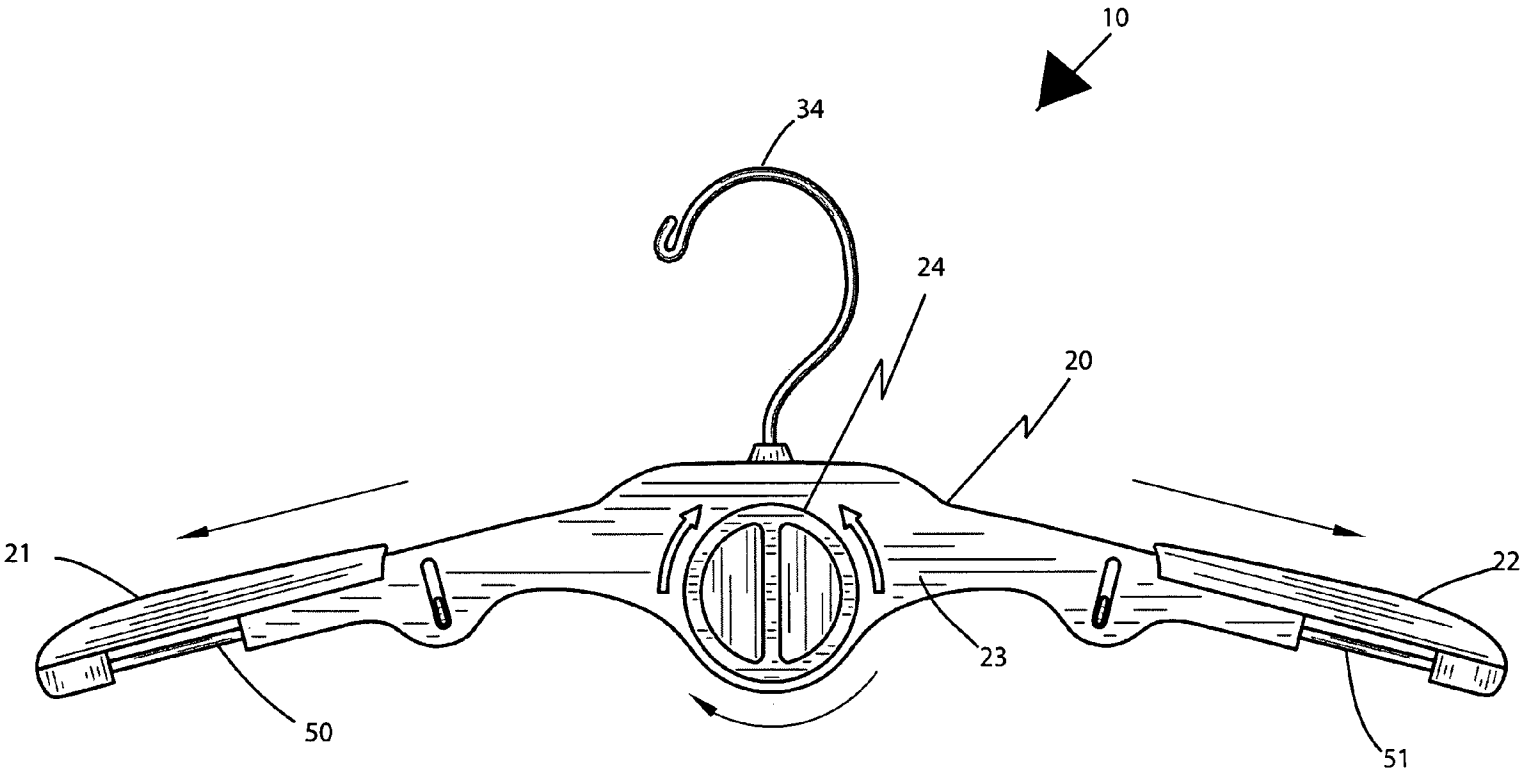
FIG. 2 is a front elevational view of an adjustable clothes hanger, with the arms in an extended position, in accordance with the present invention.
Figure 3:
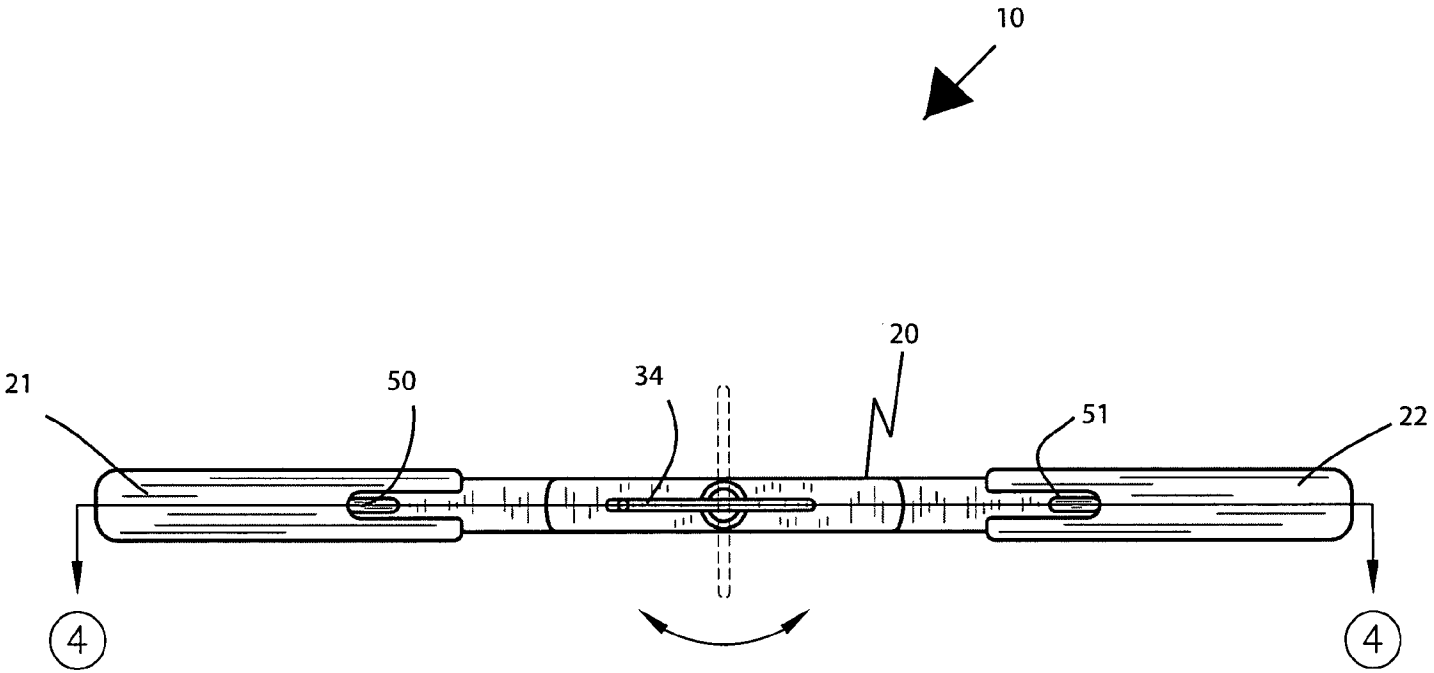
FIG. 3 is a top planar view of an adjustable clothes hanger, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-4*b* by the reference numeral 10 and is intended to protect an adjustable clothes hanger. It should be understood that the apparatus 10 may be used to protect many different types of hangers and should not be limited in use with only those types of hangers mentioned herein.

Referring initially to FIGS. 1, 2, 3, 4*a* and 4*b*, an adjustable clothes hanger 10 includes a hollow body 20 provided with a chamber 23 formed therein, and first and second arms 21, 22 conjoined to the body 20 and disposed exterior of the chamber 22. The chamber 23 houses mechanisms for adjusting the extension of the first and second arms 21, 22.

Figure 4A:
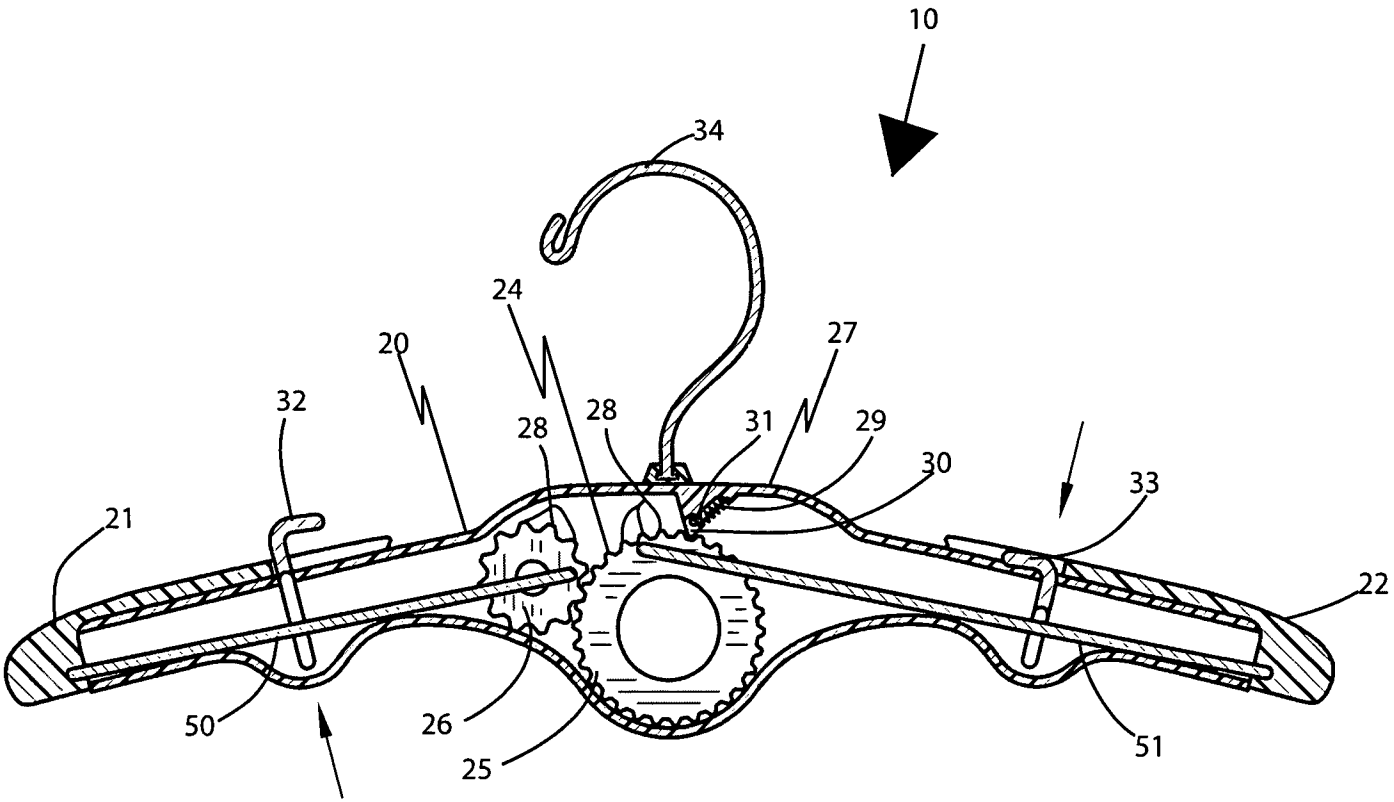
FIG. 4*a* is a cross sectional view of an adjustable clothes hanger, taken along line 4-4, as seen in FIG. 3.
Figure 4B:
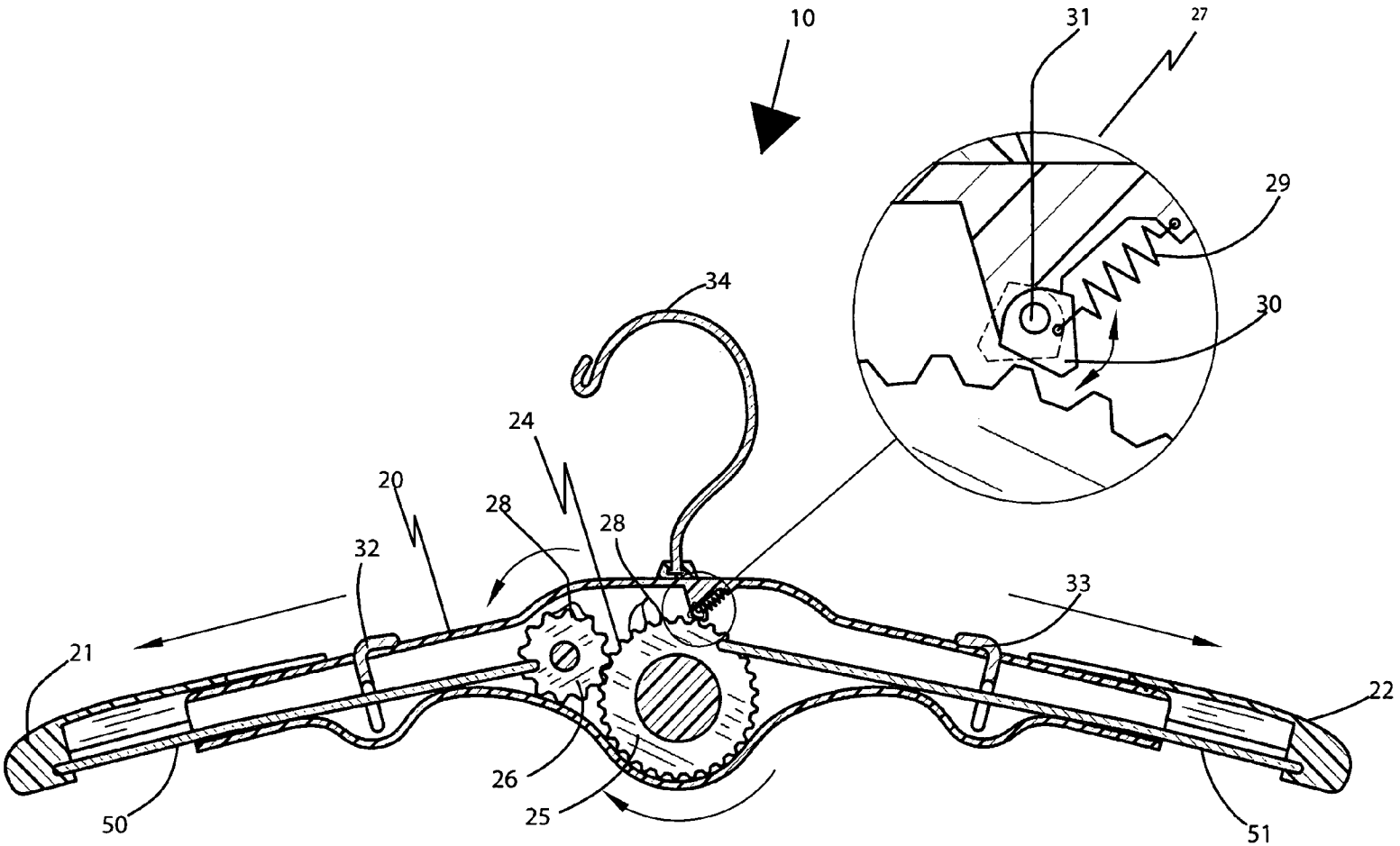
FIG. 4*b* is a cross sectional view of an adjustable clothes hanger, with arms in an extended position, taken along line 4-4, as seen in FIG. 3.

Referring to FIGS. 4*a* and 4*b*, the device 10 further includes a mechanism 24 for slidably and linearly displacing the first and second arms 21, 22 along respective linear paths in such a manner that the first and second arms 21, 22 simultaneously extend and retract along opposed flanges of the body 20. Such a slidably and linearly displacing mechanism 24 includes first and second rectilinear rods 50, 51 with respective distal ends directly anchored, without the use of intervening elements, to the distal ends of the first and second arms 21, 22 in such a manner that the distal ends are disposed externally of the chamber 23 when the first and second arms 21, 22 are adapted to laterally extend positions respectively.

The mechanism 24 further includes a primary dial 25 seated within the chamber 23 that rotates in clockwise and counter clockwise directions, and a secondary dial 26 seated within the chamber 23 and directly engaged, without the use of intervening elements, with the primary dial 25. Such a secondary dial 26 is rotated along counter clockwise and clockwise directions when the primary dial 25 is rotated in clockwise and counter clockwise directions respectively. The slidably and linearly displacing mechanism 24 further includes a mechanism 27 for providing a resilient force that resists undesirable rotation of the primary dial 25 when the garments are supported and removed by the first and second arms 21, 22. Each of the primary and secondary dials 25, 26 is provided with a plurality of teeth 28 juxtaposed along respective outer perimeters thereof. The slidably and linearly displacing mechanism 24 enables a user to adjust the arms 21, 22 to an extent appropriate for the garment to be hung.

Referring again to FIGS. 4*a* and 4*b*, the resilient force providing mechanism 27 includes a deformably resilient spring member 29 oriented along a sloping angle offset from a horizontal plane which is essential such that a bottom end of the spring members 29 is seated adjacent to the primary dial 25 while a top end of the spring member 29 is anchored to an inner surface of the body 20. A finger 30 is monolithically formed with the body 20 and nested within the chamber 23, and such a finger 30 is juxtaposed adjacent to the primary dial 25 and adjoined to the outer perimeter thereof. The mechanism 27 further includes a bracket 31 pivotally coupled directly, without the use of intervening elements, to the finger 30. Such a bracket 31 is coupled directly, without the use of intervening elements, to the spring member 29 and rotated along an arcuate path defined along the outer perimeter of the primary dial 25 which is vital such that the bracket 31 selectively engages the teeth 28 of the primary dial 25 as the spring member 29 is adapted between compressed and equilibrium positions respectively. The spring member 29 is compressed when the bracket 31 engages the outer perimeter of the primary dial 25, and the first and second rectilinear rods 50, 51 are coupled directly, without the use of intervening elements, to the primary and secondary dials 25, 26 respectively.

Referring to FIGS. 1, 2, 3, 4*a* and 4*b*, the device 10 further includes first and second hooks 32, 33 partially seated within the chamber 23 and disposed along the flanges. Each of such first and second hooks 32, 33 has top ends terminating outwardly from the chamber 23 and traversing respective travel paths of the first and second arms 21, 22 when the primary and secondary dials 25, 26 are rotated in corresponding directions which is important such that the first and second arms 21, 22 are engaged and stopped from traveling therebeyond. The first and second arms 21, 22 are prohibited from medially traveling beyond corresponding limits defined towards a center of the body 20, and a primary hook 34 is rotatably connected to a top edge of the body 20 and disposed exterior of the chamber 23. The first and second hooks 32, 33 are provided for use when hanging a tank top style garment.

Use of the adjustable clothes hanger is very simple and straightforward. For a big sweater, the user should turn the device dial clockwise to expand the arms length. Alternately, the user should turn the dial counterclockwise to minimize the length for a petite item. For a tank top or spaghetti strap item, the use should push the front slide buttons to expose the optional hooks, ensuring the item will not slide. If the hooks are no longer needed, they retract into the hanger body via the slide buttons. Once the proper length is determined, and hooks are exposed if needed, the use should simply hang the item on the device and then hang it on a clothing rod.

The present invention, as claimed, provides the unexpected and unpredictable benefit of a device that provides a simple and efficient method for hanging clothes in a more careful manner. Providing ample room on which sweaters, jackets, sweat shirts and similar goods could be neatly hung, the adjustable clothes hanger ensures that these items maintain their pristine and new appearance. Eliminating the unsightly "bumps" and "points" which so often occur when heavy shirts are hung on standard wire or plastic hangers, use of this device could effectively make it easier to maintain a neat, professional appearance.

By sliding the guard rails, a user can expand or contract the adjustable clothes hanger to perfectly fit any item, enabling them to customize the device to fit their entire wardrobe. Boating a non-slip coating which encompasses the end of each hanger arm, garments hung on the adjustable clothes hanger would never slide or fall off during use. Eliminating the frustrations of pointy shoulders, and wrinkles due to sliding and bunching, the device ensures a fresh, just-pressed appearance.

In use, a method for adjusting a size of a clothes hanger in order to accommodate alternate sized garments includes the steps of: providing a hollow body with a chamber formed therein; conjoining first and second arms to the body by disposing the first and second arms exterior of the chamber; providing first and second hooks partially seated within the chamber and disposed along flanges of the body; slidably and linearly displacing the first and second arms along respective linear paths in such a manner that the first and second arms simultaneously extend and retract along opposed flanges of the body; and traversing top ends of the hooks along travel paths of the first and second arms by rotating the primary and secondary dials in corresponding directions such that the first and second arms are engaged and stopped from traveling therebeyond.

In use, the method further includes the steps of: providing first and second rectilinear rods with respective distal ends directly anchored, without the use of intervening elements, to the distal ends of the first and second arms; externally disposing the distal ends from the chamber by adapting the first and second arms to laterally extended positions respectively; providing a primary dial seated within the chamber; rotating the primary dial in clockwise and counter clockwise directions; providing a secondary dial seated within the chamber by directly engaging, without the use of intervening elements, the secondary dial with the primary dial; rotating the secondary dial along counter clockwise and clockwise directions by rotating the primary dial in clockwise and counter clockwise directions respectively; and providing a resilient force that resists undesirable rotation of the primary dial when the garments are supported and removed by the first and second arms.

In use, the method further includes the steps of: orienting a deformably resilient spring member along a sloping angle offset from a horizontal plane such that a bottom end of the spring members is seated adjacent to the primary dial; anchoring a top end of the spring member to an inner surface of the body; providing a finger monolithically formed with the body and nested within the chamber; providing a bracket pivotally coupled directly, without the use of intervening elements, to the finger; and rotating the bracket along an arcuate path defined along the outer perimeter of the primary dial such that the bracket selectively engages the teeth of the primary dial as the spring member is adapted between compressed and equilibrium positions respectively.

In use, the method further includes the steps of: compressing the spring member by engaging the bracket with the outer perimeter of the primary dial; and rotatably connecting a primary hook to a top edge of the body and disposed exterior of the chamber.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. An adjustable clothes hanger for accommodating alternate sized garments, said adjustable clothes hanger comprising:

a hollow body provided with a chamber formed therein;

first and second arms conjoined to said body and disposed exterior of said chamber; and means for slidably and linearly displacing said first and second arms along respective linear paths in such a manner that said first and second arms simultaneously extend and retract along opposed flanges of said body;

wherein said first and second arms are prohibited from medially traveling beyond corresponding limits defined towards a center of said body;

wherein said slidably and linearly displacing means comprises first and second rectilinear rods having respective distal ends directly anchored to said distal ends of said first and second arms in such a manner that said distal ends are disposed externally of said chamber when said first and second arms are adapted to laterally extend positions respectively;

a primary dial seated within said chamber and being rotated in clockwise and counter clockwise directions;

a secondary dial seated within said chamber and being directly engaged with said primary dial, said secondary dial being rotated along counter clockwise and clockwise directions when said primary dial is rotated in clockwise and counter clockwise directions respectively; and means for providing a resilient force that resists undesirable rotation of said primary dial when the garments are supported and removed by said first and second arms;

wherein each of said primary and secondary dials are provided with a plurality of teeth juxtaposed along respective outer perimeters thereof;

wherein said resilient force providing means comprises a deformably resilient spring member oriented along a sloping angle offset from a horizontal plane such that a bottom end of said spring members is seated adjacent to said primary dial while a top end of said spring member is anchored to an inner surface of said body;

a finger monolithically formed with said body and nested within said chamber, said finger being juxtaposed adjacent to said primary dial and adjoined to said outer perimeter thereof; and a bracket pivotally coupled directly to said finger, said bracket being coupled directly to said spring member and rotated along an arcuate path defined along said outer perimeter of said primary dial such that said bracket selectively engages said teeth of said primary dial as said spring member is adapted between compressed and equilibrium positions respectively.

2. The adjustable clothes hanger of claim 1, wherein said spring member is compressed when said bracket engages said outer perimeter of said primary dial.

3. The adjustable clothes hanger of claim 1, wherein said first and second rectilinear rods are coupled directly to said primary and secondary dials respectively.

4. The adjustable clothes hanger of claim 1, further comprising: a primary hook rotatably connected to a top edge of said body and disposed exterior of said chamber.

5. An adjustable clothes hanger for accommodating alternate sized garments, said adjustable clothes hanger comprising:

a hollow body provided with a chamber formed therein;

first and second arms conjoined to said body and disposed exterior of said chamber;

means for slidably and linearly displacing said first and second arms along respective linear paths in such a manner that said first and second arms simultaneously extend and retract along opposed flanges of said body;

wherein said slidably and linearly displacing means comprises first and second rectilinear rods having respective distal ends directly anchored to said distal ends of said first and second arms in such a manner that said distal ends are disposed externally of said chamber when said first and second arms are adapted to laterally extend positions respectively;

a primary dial seated within said chamber and being rotated in clockwise and counter clockwise directions;

a secondary dial seated within said chamber and being directly engaged with said primary dial, said secondary dial being rotated along counter clockwise and clockwise directions when said primary dial is rotated in clockwise and counter clockwise directions respectively; and means for providing a resilient force that resists undesirable rotation of said primary dial when the garments are supported and removed by said first and second arms;

wherein each of said primary and secondary dials are provided with a plurality of teeth juxtaposed along respective outer perimeters thereof;

first and second hooks partially seated within said chamber and disposed along said flanges, each of said first and second hooks having top ends terminating outwardly from said chamber and traversing respective travel paths of said first and second arms when said primary and secondary dials are rotated in corresponding directions such that said first and second arms are engaged and stopped from traveling therebeyond; and wherein said first and second arms are prohibited from medially traveling beyond corresponding limits defined towards a center of said body;

wherein said resilient force providing means comprises:

a deformably resilient spring member oriented along a sloping angle offset from a horizontal plane such that a bottom end of said spring members is seated adjacent to said primary dial while a top end of said spring member is anchored to an inner surface of said body;

a finger monolithically formed with said body and nested within said chamber, said finger being juxtaposed adjacent to said primary dial and adjoined to said outer perimeter thereof; and a bracket pivotally coupled directly to said finger, said bracket being coupled directly to said spring member and rotated along an arcuate path defined along said outer perimeter of said primary dial such that said bracket selectively engages said teeth of said primary dial as said spring member is adapted between compressed and equilibrium positions respectively;

wherein said spring member is compressed when said bracket engages said outer perimeter of said primary dial such that said bracket is rotated upwardly towards said spring member, said bracket being rotated downwardly towards said outer perimeter of said primary dial when said spring member returns to the equilibrium position;

wherein said first and second rectilinear rods are coupled directly to said primary and secondary dials respectively;

wherein said finger remains at a static and fixed position as said bracket is pivoted during rotation of said primary dial;

wherein said primary dial has a diameter that is greater than a diameter of said secondary dial;

wherein each of said first and second rectilinear rods further has a proximal end directly anchored to said primary and secondary dials such that said proximal ends terminate at said primary and secondary dials respectively.

6. The adjustable clothes hanger of claim 5, further comprising: a primary hook rotatably connected to a top edge of said body and disposed exterior of said chamber.

7. A method for adjusting a size of a clothes hanger in order to accommodate alternate sized garments, said method comprising the steps of:

a. providing a hollow body having a chamber formed therein;

b. conjoining first and second arms said body by disposing said first and second arms exterior of said chamber;

c. providing first and second hooks partially seated within said chamber and disposed along flanges of said body;

d. slidably and linearly displacing said first and second arms along respective linear paths in such a manner that said first and second arms simultaneously extend and retract along opposed flanges of said body, wherein step d. further comprises the steps of providing first and second rectilinear rods having respective distal ends directly anchored to said distal ends of said first and second arms, externally disposing said distal ends from said chamber by adapting said first and second arms to laterally extended positions respectively, providing a primary dial seated within said chamber, rotating said primary dial in clockwise and counter clockwise directions, providing a secondary dial seated within said chamber by directly engaging said secondary dial with said primary dial, rotating said secondary dial along counter clockwise and clockwise directions by rotating said primary dial in clockwise and counter clockwise directions respectively, and providing a resilient force that resists undesirable rotation of said primary dial when the garments are supported and removed by said first and second arms; and e. traversing top ends of said hooks along travel paths of said first and second arms by rotating said primary and secondary dials in corresponding directions such that said first and second arms are engaged and stopped from traveling therebeyond;

wherein step d. further comprises the steps of orienting a deformably resilient spring member along a sloping angle offset from a horizontal plane such that a bottom end of said spring members is seated adjacent to said primary dial;

anchoring a top end of said spring member to an inner surface of said body;

providing a finger monolithically formed with said body and nested within said chamber;

providing a bracket pivotally coupled directly to said finger;

rotating said bracket along an arcuate path defined along said outer perimeter of said primary dial such that said bracket selectively engages said teeth of said primary dial as said spring member is adapted between compressed and equilibrium positions respectively.

8. The method of claim 7, further comprising the steps of: compressing said spring member by engaging said bracket with said outer perimeter of said primary dial.

9. The method of claim 7, further comprising the steps of: rotatably connecting a primary hook to a top edge of said body and disposed exterior of said chamber.

* * * * *